US005744786A

United States Patent [19]

Kim

[11] Patent Number: 5,744,786

[45] Date of Patent: Apr. 28, 1998

[54] AUTOMATIC COOKING APPARATUS HAVING TURNTABLE AND INFRARED TEMPERATURE SENSOR

[75] Inventor: Tae Yoon Kim, Kyungki-do, Rep. of Korea

[73] Assignee: LG Electronics Inc., Seoul, Rep. of Korea

[21] Appl. No.: 637,406

[22] Filed: Apr. 25, 1996

[30] Foreign Application Priority Data

May 16, 1995 [KR] Rep. of Korea ..... 12104/1995

[51] Int. Cl.[6] ..... H05B 6/68; H05B 6/78

[52] U.S. Cl. ..... 219/711; 219/754; 219/494; 219/510; 374/121; 374/149; 99/325

[58] Field of Search ..... 219/711, 710, 219/494, 510, 754; 374/121, 124, 129, 149; 99/325

[56] References Cited

U.S. PATENT DOCUMENTS 3,639,765 2/1972 Kleinerman ..... 374/124
3,854,336 12/1974 Bibby ..... 374/124
3,924,469 12/1975 Brandli et al. ..... 374/129

FOREIGN PATENT DOCUMENTS 57-41528 3/1982 Japan ..... 219/711
58-210419 12/1983 Japan ..... 219/711
6-265152 9/1994 Japan ..... 219/711

*Primary Examiner*—Philip H. Leung
*Attorney, Agent, or Firm*—John P. White

[57] ABSTRACT

Apparatus for automatic cooking of a cooking object in a cooking apparatus, such as a microwave oven, in which a surface temperature of the cooking object is accurately detected for automatic cooking of the cooking object, is disclosed, including infrared radiation extracting part having an angle of view of a predetermined form toward one side of the turntable for extracting an infrared radiation radiated from a surface of a cooking object; and temperature detecting part having a window with an elliptical angle of view for reception of the infrared radiation for detection of a temperature of the surface of the cooking object.

8 Claims, 3 Drawing Sheets

FIG. 3A
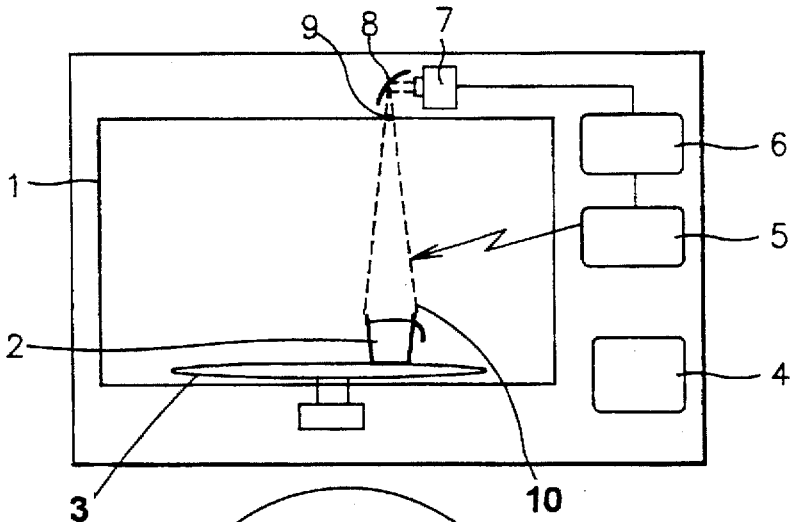
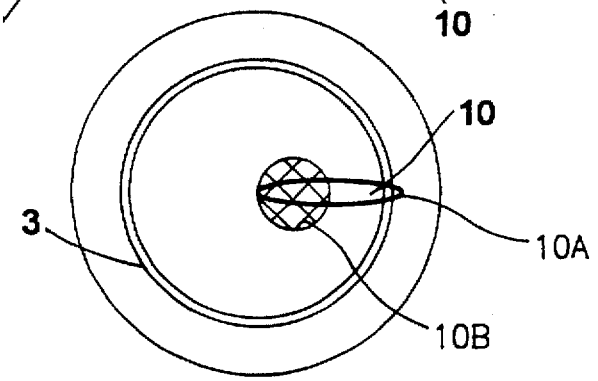
FIG. 3B

AUTOMATIC COOKING APPARATUS HAVING TURNTABLE AND INFRARED TEMPERATURE SENSOR

BACKGROUND OF THE INVENTION

The present invention relates to an apparatus for automatic cooking of a cooking object in a cooking apparatus, such as microwave oven, in which a surface temperature of the cooking object is accurately detected for automatic cooking of the cooking object.

FIGS. 1A and 1B illustrate a conventional cooking apparatus which can also detects the surface temperature of the cooking object for automatic cooking.

As shown in FIGS. 1A and 1B, the conventional cooking apparatus includes a cooking chamber 1 for placing food 2 therein for cooking, a turntable 3 in the cooking chamber 1 for placing the food 2 thereon and being turned for uniform heating of the food 2, a menu selecting key pad 4 for selecting a menu mode by a user, a heating part 5 for generating microwave for cooking the food, a controlling part 6 for conduction of various automatic control, and a temperature detecting part 7 having an angle of view covering entire surface of the turntable 3 for detecting a temperature radiated from a surface of the food under cooking.

The operation of the conventional cooking apparatus is as follows;

First, food is placed on the turntable in the cooking chamber 1, and a door to the cooking chamber is closed.

Then, when the user selects a menu mode on the menu selecting key pad 4, the controlling part 6 generates different controlling signals for operating the heating part 5 and turning the turntable 3.

Then, heated by microwaves from the heating part 5, cooking of the food on the turntable 3 is proceeded.

In this time, the temperature detecting part 7 detects an infrared radiation emitted from the food 2 under cooking to detect a surface temperature of the food 2.

In case the surface temperature is the same with a menu mode temperature set in the controlling part 6, the controlling part 6 stops the menu mode operation.

Since the temperature detecting part 7 has an angle 10 of view for detection of infrared radiations covering the entire surface of the turntable 3, there has been a problem that an accurate temperature only of the food under cooking can not be detected in case a size of the food is smaller than an area made by the angle of view, or a small sized food is placed at the rim of the turntable.

That is, there has been a problem that the sensor can not sense an accurate food temperature, not only due to too small a ratio of a projection area of the food to the area made by the angle of view of the sensor considering the performance of the sensor that generates an average value, but also, as shown in FIG. 2, due to an error of the detected food temperature which becomes greater as the angle of view of the food becomes greater, even if the food temperature is the same, depending on a distance from the food to the sensor (a thickness of the food), coming from sudden increase of influence of the distance to the output of the sensor as the angle of view of the food increases.

In order to solve such a disadvantage, an art suggested is the JP laid open patent H6-193883. That is, by means of an infrared sensor with a narrow angle of view used as the temperature detector, and with a driving means which drives the infrared sensor to scan in a transverse direction while moving the sensor longitudinally to obtain a two dimensional thermal image of the heating chamber seen from the top, the JP laid open patent H6-193883 facilitates detection of a more accurate food surface temperature regardless of a shape and position of the food for automatic cooking.

However, aforementioned system raises a difficult problem in putting the invention into a product of practical use because the system makes the cooking apparatus larger and the additional sensor driving means pushes up the product cost.

SUMMARY OF THE INVENTION

Therefore, the object of the present invention for solving aforementioned problem is to provide an automatic cooking apparatus, in which infrared view angles of a reflector and a temperature detecting part are adjusted for detecting an accurate surface temperature of food, for automatic cooking of the food at a low cost.

In the primary object of the present invention, there is provided an automatic cooking apparatus having a cooking chamber and a turntable, the automatic cooking apparatus including infrared radiation extracting means having an angle of view of a predetermined form toward one side of the turntable for extracting an infrared radiation radiated from a surface of a cooking object, and temperature detecting means having a window with an elliptical angle of view for reception of the infrared radiation for detection of a temperature of the surface of the cooking object.

BRIEF DESCRIPTION OF THE DRAWINGS

FIGS. 3A and 3B illustrate an automatic cooking apparatus in accordance with the present invention.

DETAILED DESCRIPTION OF THE PREFERRED EMBODIMENTS

Figure 1A:
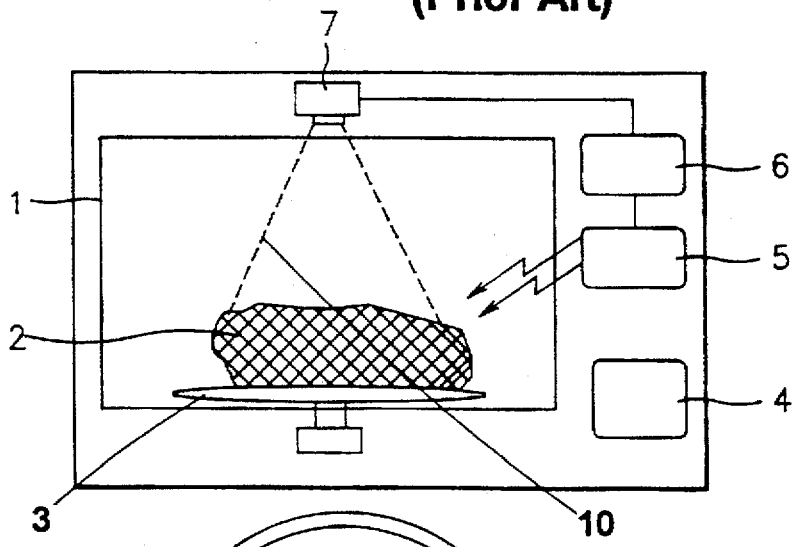
FIG. 1A (Prior Art)
FIGS. 1A and 1B illustrate a system of a conventional cooking apparatus.
Figure 1B:
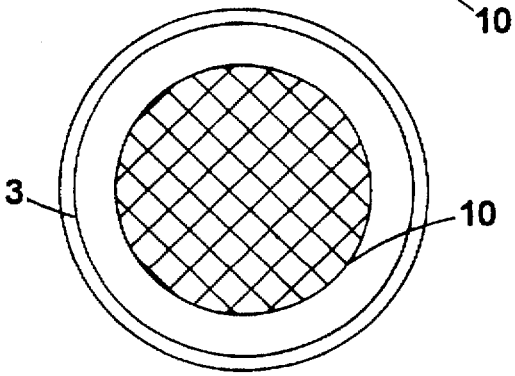
FIG. 1B (Prior Art)
Figure 2:
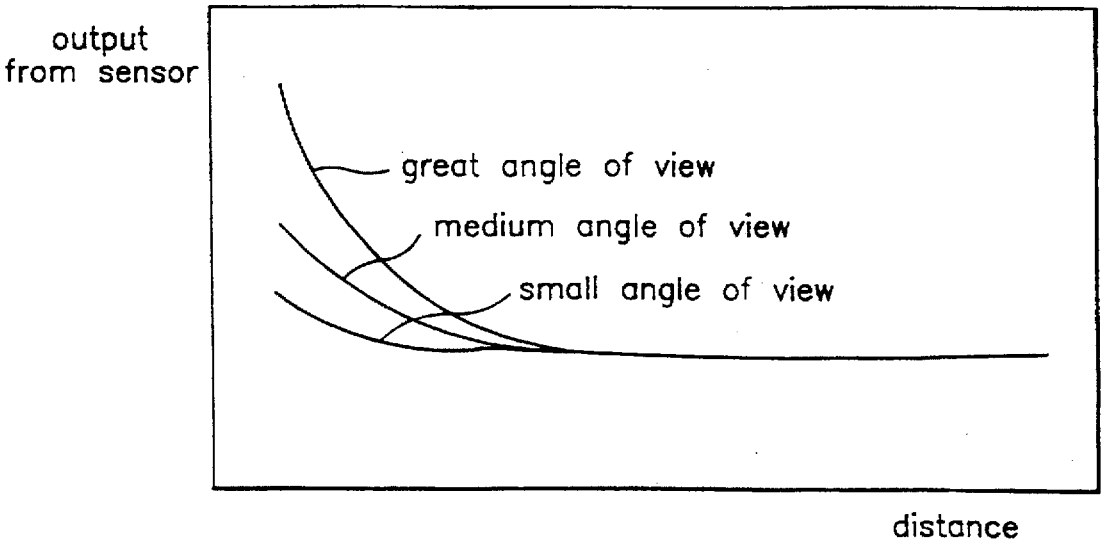
FIG. 2 illustrates a graph showing output intensity of an infrared sensor versus angle of view of the infrared sensor and distance from the sensor to food.

An automatic cooking apparatus in accordance with the present invention will now be explained in detail with reference to the attached drawings.

The present invention provides an automatic cooking apparatus, including infrared radiation extracting means for extracting an infrared radiation radiated from food using an elliptical angle of view of a reflector, and temperature detecting means for receiving the infrared radiation through an elliptical angle of view of a window for detection of a surface temperature of the food.

FIGS. 3A and 3B illustrate a system of the automatic cooking apparatus of the present invention.

The system of the automatic cooking apparatus of the present invention includes a cooking chamber 1 for placing food 2 therein for cooking, a turntable 3 for placing the food 2 thereon for turning the food for uniform heating of the food, a menu selecting key pad 4 for selection of a menu mode thereon by a user, a heating part 5 for generating microwave for heating the food for cooking, a controlling part 6 for conducting different automatic controls, a temperature detecting part 7 having a thermopile type sensor for detecting a surface temperature of the food being cooked from an infrared radiation radiated from the food and received through a window, a reflector 8 having an elliptical angle of view for collecting the infrared radiation radiated from the food at cooking the food and reflecting the infrared radiation toward the window of the temperature detecting part 7, and an infrared radiation filter 9 for preventing the temperature detecting part 7 from contamination or degradation of sensor performance due to direct contact of vapor and like in the cooking chamber as well as for transmission of infrared radiation waves toward the reflector 8.

The reflector 8 having a long but narrow elliptical form is adopted to sense entire surface of the turntable as it turns. That is, wherever the position of the food 2 on the turntable is, the food is made to come into the view of the temperature sensor 7.

The temperature sensor 7 includes an infrared detector, such as thermopile sensor and a window of a narrow elliptical form.

In carrying out an automatic cooking using the thermopile sensor which measures a temperature of an object within its view, the thermopile sensor can generate a stable signal in case a size of the cooking object is significantly larger than the angle of view of the thermopile sensor even though the angle of view is narrow and the turntable turns, and facilitates an accurate control, different from a thermopile senor having a wide angle of view, as the thermopile sensor can exclude the influence from the distance.

Figure 4:
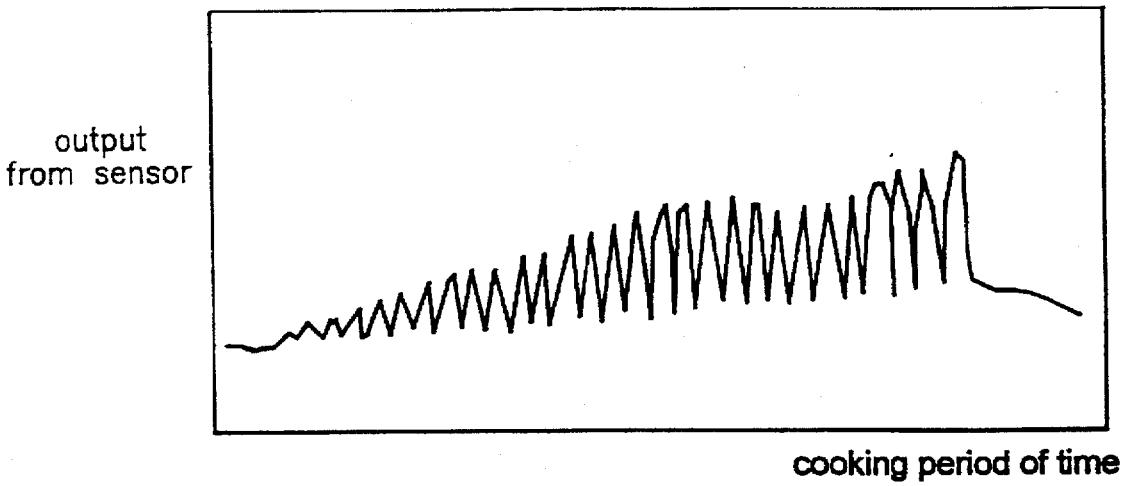
FIG. 4 illustrates output from a temperature detecting apparatus under a general cooking in one embodiment of the present invention.

However, in cases when the size of the cooking object is small or the cooking object is not laid on the center of the turntable accurately, as shown in FIG. 4, a signal from the thermopile sensor exhibits maximums and minimums according to the turning period of the turntable. But this is only change in pattern of the signal depending on the size of the food.

That is, at general cooking other than defrosting, every maximum is a value taken when the cooking object comes into the angle of view of the sensor, the nearest to the sensor, and every minimum is a value taken when the cooking object is distanced, the farthest.

Figure 5:
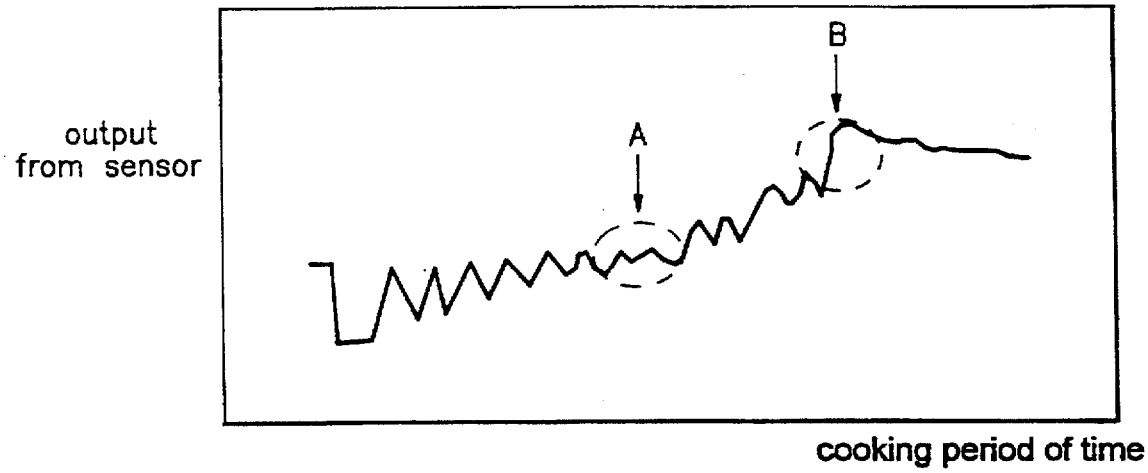
FIG. 5 illustrates output from a temperature detecting apparatus under a defrosting in one embodiment of the present invention.

On the other hand, as shown in FIG. 5 in case of defrosting, the minimum is a value taken when the cooking object comes the nearest, and the maximum is a value taken when the cooking object is distanced the farthest.

And, as the defrosting proceeds, the difference between the maximum and the minimum is getting smaller until a point when the signal taken becomes the same with a general cooking, which represents a point at which the defrosting has been finished and a general cooking is started ("B" in FIG. 5). in case of a defrosting, a finishing time should be set at a point before such a change occurs ("A" in FIG. 5).

In the present invention, in order to sense a surface temperature of small sized food accurately wherever the food is placed on the turntable, the temperature detecting part 7 and reflector 8 having a narrow elliptical area of views are used for taking, a signal from the sensor at regular intervals identical to the turning period of the turntable, for controlling the cooking.

The elliptical reflector 8 for collecting infrared radiations radiated from the food at cooking and reflecting the collected infrared radiations toward the window of the infrared radiation sensor collects the infrared radiations and makes a view of the sensor into a long elliptical form; though a circular view (10B in FIG. 3B) having an area the same with the elliptical form can provide an accurate signal generation characteristic, while it can not cover entire surface of the turntable of the cooking apparatus, the reflector of elliptical view (10A in FIG. 3B) formed to have the same area with the circular view can make an accurate sensing even though the food is small sized or placed at a place other than the center of the turntable since the elliptical view is brought entire surface of the turntable into its scope of sensing, resulting to exclude the sensor performance that the sensor generates an average of the temperature within its area of view even if a ratio of its area of view to the area of the food is great.

An embodiment of the cooking control of the automatic cooking apparatus in accordance with the present invention having aforementioned system will be explained.

When a user inputs a cooking selecting key on the menu selecting key pad 4 of a cooking apparatus, detecting input of a selecting key, such as defrosting or others, a cooking is started in the selected mode, such as defrosting or warming up.

In general, before starting of a heating means, i.e., a magnetron, a microwave oven has its control means 6 to confirm door closure and initialize the condition in the cooking chamber by driving the turntable and a fan for a predetermined time period.

As the heating means is operated, temperature of the cooking object rises, and an infrared radiation corresponding to the temperature is radiated.

In this time, the elliptical reflector 8, integrated with the cooking chamber or with the food temperature detecting apparatus, collects the infrared radiations incident thereto through the infrared radiation filter which prevents degradation of sensor performance and contamination of sensor coming from direct contact of vapor and the like in the cooking chamber, and transmits infrared radiation waves, and reflects the infrared radiations toward the temperature detecting part 7.

The temperature detecting part 7 senses a surface temperature of an body within its elliptical view and generates an output to be applied to the controlling part 6 having a microcomputer.

For a predetermined initial period of time, the microcomputer determines whether the output periodically varies in a period identical to the turning period (0.1 Hz, in general) of the turntable 3, if found so, maximums and minimums of a same period are taken until the cooking is finished.

If no periodicity is found inspite of the turn of the turntable 3, indicating that size of the cooking object is larger than view angle of the sensor resulting in a stable generation of the signal by the sensor, the cooking can be controlled according to a predetermined control mode until finish of the cooking using the signal itself.

On the other hand, if it is determined that there is a periodicity, the maximums and minimums are taken in regular intervals, wherein each of the sensed maximum and minimum is compared to an magnetron operation stop point, to stop the operation of the magnetron when the sensor output comes over this stop point.

In the meantime, when the signal from the sensor does not come below a value predetermined according to the purpose of cooking anymore after a predetermined count, i.e., a predetermined time period, the cooking is finished.

And, as other embodiment of the present invention, either one of the window of the temperature detecting part 7 or the reflector 8 may be provided to have an elliptical angle of view to have an elliptical area of view, of which function is the same with the first embodiment, with an identical system except the aboves.

Therefore, the operation of the other embodiment of the present invention is the same with the operation of the first embodiment.

As has been explained, since the cooking apparatus of the present invention can make an accurate sensing of a cooking condition of a cooking object by means of an elliptical reflector and/or a window of a temperature detecting part having a narrow elliptical angle of view which allows sensing of entire surface of a turntable, a cooking, such as defrosting or warming up of an optimal condition can be carried out, and various cooking functions and cooking menu are made available.

Although the invention has been described in conjunction with specific embodiments, it is evident that many alternatives and variations will be apparent to those skilled in the art in light of the foregoing description. Accordingly, the invention is intended to embrace all of the alternatives and variations that will fall within the spirit and scope of the appended claims.

What is claimed is:

1. An automatic cooking apparatus having a cooking chamber and a turntable, the automatic cooking apparatus comprising:

infrared radiation extracting means having an angle of view of a predetermined form toward one side of the turntable for extracting an infrared radiation radiated from a surface of a cooking object; and, temperature detecting means having a window with an elliptical angle of view for reception of the infrared radiation for detection of a temperature of the surface of the cooking object;

wherein the angle of view of the infrared radiation extracting means includes the center and a part of the rim of the turntable; and wherein the infrared radiation extracting means includes a reflector having an elliptical angle of view for collecting and reflecting infrared radiations from the cooking object, and a filter for transmission of infrared radiation waves from the cooking object toward the reflector.

2. An automatic cooking apparatus as claimed in claim 1, wherein entire surface of the turntable is sensed by means of the angle of view of the infrared radiation extracting means and turn of the turntable.

3. An automatic cooking apparatus as claimed in claim 1, wherein either one of the infrared radiation extracting means or the temperature detecting means has the elliptical angle of view.

4. An automatic cooking apparatus comprising:

a cooking chamber for cooking food;

a turntable disposed in the cooking chamber for turning the food;

a menu selecting key pad for selection of a menu mode;

a heating part for generating microwave for heating the food;

a reflector having an elliptical angle of view for collecting and reflecting the infrared radiations radiated from the food heated by the heating part;

a temperature detecting part having a window of an elliptical form for detecting a surface temperature of the cooking object from an infrared radiation reflected at the reflector;

a filter for transmission of infrared radiation waves toward the reflector; and, a controlling part for controlling the cooking according to the menu selected at the key pad and the surface temperature of the cooking object having detected.

5. An automatic cooking apparatus as claimed in claim 4, wherein the elliptical angle of view of the reflector is arranged to face a radius of the turntable including the center and a part of the rim of the turntable.

6. An automatic cooking apparatus as claimed in claim 4, wherein the elliptical angle of view of the reflector is arranged to sense entire surface of the turntable as the turntable turns.

7. An automatic cooking apparatus as claimed in claim 4, wherein a long axis of the elliptical angle of view is arranged to cover an ⅓ of the radius of the turntable.

8. An automatic cooking apparatus as claimed in claim 4, wherein one of the reflector and the temperature detecting part is provided to have the elliptical angle of view.

* * * * *